US011142958B1

(12) United States Patent
Nguyen

(10) Patent No.: US 11,142,958 B1
(45) Date of Patent: Oct. 12, 2021

(54) DUAL FUNCTION PRESSURE COMPENSATOR FOR A LUBRICANT RESERVOIR OF A SEALED ROCK BIT

(71) Applicant: Nam Duy Nguyen, Lewisville, TX (US)

(72) Inventor: Nam Duy Nguyen, Lewisville, TX (US)

( * ) Notice: Subject to any disclaimer, the term of this patent is extended or adjusted under 35 U.S.C. 154(b) by 0 days.

(21) Appl. No.: 17/200,755

(22) Filed: Mar. 12, 2021

(51) Int. Cl.
*E21B 10/24* (2006.01)
*E21B 10/25* (2006.01)
*E21B 10/18* (2006.01)

(52) U.S. Cl.
CPC ..... *E21B 10/24* (2013.01); *E21B 10/18* (2013.01); *E21B 10/25* (2013.01)

(58) Field of Classification Search
CPC ..... E21B 10/18; E21B 10/22; E21B 10/23; E21B 10/24; E21B 10/25
See application file for complete search history.

(56) References Cited

U.S. PATENT DOCUMENTS 3,303,898 A * 2/1967 Bercaru ..... E21B 10/24 175/228
3,844,364 A * 10/1974 Crow ..... E21B 10/246 175/228
4,386,668 A * 6/1983 Parish ..... E21B 10/23 175/228
5,012,876 A * 5/1991 Bruchmiller ..... E21B 10/18 175/318
5,183,123 A * 2/1993 White ..... E21B 47/095 175/228
6,053,264 A * 4/2000 Frankel ..... E21B 10/20 175/367
6,206,110 B1 * 3/2001 Slaughter, Jr. ..... E21B 10/003 175/227
6,296,067 B1 * 10/2001 Slaughter, Jr. ..... E21B 10/003 175/227
6,513,607 B2 * 2/2003 Peterson ..... E21B 10/24 175/337
6,619,412 B2 * 9/2003 Slaughter, Jr. ..... E21B 10/003 175/228
7,975,782 B2 * 7/2011 Peterson ..... E21B 10/24 175/227
9,657,528 B2 5/2017 Nguyen
2002/0108788 A1 * 8/2002 Peterson ..... E21B 10/25 175/228

* cited by examiner

*Primary Examiner* — Blake E Michener
(74) *Attorney, Agent, or Firm* — Guy V. Manning

(57) ABSTRACT

An earth boring bit with sealed cutter bearings has a dual function pressure compensator for a lubricant reservoir. The earth boring bit has a bit body and downwardly extending legs which include bearing shafts that extend inward and downward for mounting rotary cutters, and seals are provided between the bearing shafts and the cutters. Lubricant flow passages extend from an interior cavity of the bit body, through the legs and the bearing shafts, and into the spaces located between the bearing shafts and the cutters. The pressure compensator extends between the cavity and the flow passages and has a movable piston. The compensator may be operated in a sealed lubricant system mode when the piston is locked in place or an air flow bypass mode by removing a locking member from securing the piston in place prior to securing the earth boring bit to a drill string.

19 Claims, 5 Drawing Sheets

DUAL FUNCTION PRESSURE COMPENSATOR FOR A LUBRICANT RESERVOIR OF A SEALED ROCK BIT

TECHNICAL FIELD OF THE INVENTION

The present invention relates in general to earth boring drill bits, and in particular to an air flow bypass for use with a lubricator compensator in sealed bearing drill bits.

BACKGROUND OF THE INVENTION

Earth penetrating tools include the rotatable cutter-type earth boring drill bit, such as a rolling cone rock bit. Rolling cone earth boring bits have a bit body with an upper end adapted for connection to a drill string and typically three bit legs which extend downward from the body. Depending from the lower portion of the bit body are a plurality of support arms, typically three in number. A bearing shaft extends inward and downward from each bit leg. A conventional rock bit bearing shaft is cylindrical and rotatably receives a cutter cone. The cutter cone is generally mounted on each bearing shaft and supported rotatably on bearings acting between the spindle and the inside of a spindle-receiving cavity in each cutter cone. The cutter cones have teeth or compacts on their exteriors for disintegrating earth formations as the cones rotate on the bearing shafts. One or more fluid nozzles are often formed on the underside of the bit body. The nozzles are typically positioned to direct drilling fluid passing downwardly from the drill string toward the bottom of the borehole being drilled. Drilling fluid washes away material removed from the bottom of the borehole and cleanses the cutter cones, carrying the cuttings and other debris radially outward and then upward within an annulus defined between the drill bit and the wall of the borehole.

There are several varieties of bearing systems used to support the cutter cones. These bearing systems typically consist of a combination of radial and thrust bearings that may be either sealed and lubricated, or unsealed and open to the drilling fluid. The drilling fluid may be liquid such as drilling muds, or gaseous, such as air. Contact wear surfaces for bearing shafts may consist of wear-resistant metals or non-metals such as tungsten carbide. In sealed bearing drill bits, seals are placed across gaps between the cutter cones and respective bearing shafts to prevent debris from contaminating the bearing and also block the lubricant from leaking to the exterior. Various types of seals have been used, including elastomeric seals and metal-to-metal face seals. Open bearing drill bits operate without a seal and often pass drilling fluids through the cutter bearings for cooling and lubrication. Open bearings often have ports to force drilling fluid through the bearing system to lubricate and cool bearing wear surfaces. In some instances air may be used for the drilling fluid and driven through the bearing to cool and to lubricate the bearings.

When operated in a borehole filled with liquid, hydrostatic pressure acts on the drill bit as a result of the weight of the column of drilling fluid. Temperature increases in the lubricant from heat transfer as the bit is lowered into the well and due to friction heat while rotating causes expansion of the lubricant. A sealed, grease-lubricated bearing drill bit contains a lubricant reservoir in the bit body that supplies lubricant to the bearing shafts. Each bearing shaft has a pressure compensation system that is mounted in the lubricant reservoirs in the bit body. Sealed bearing drill bits commonly use lubrication systems that include a lubricant pressure compensator to limit the pressure differential between the lubricant and the pressure in the borehole. A typical lubricant compensator includes a flexible diaphragm or a spring biased piston separating a lubricant reservoir and the lubricant from the borehole fluid. The diaphragm or spring biased piston moves in response to the pressure differential across it tending to equalize the pressure differential between the lubricant reservoir pressure and the borehole fluid pressure. A lubricant flow passage extends from the reservoir of the compensator to an exterior portion of the bearing shaft. The pressure compensation system has a communication port that communicates with the hydrostatic pressure on the exterior to equalize the pressure on the exterior with lubricant pressure in the passages and clearances within the drill bit. The viscous lubricant creates hydrodynamic lift as the cone rotates on the bearing shaft so that the load is partially supported by lubricant fluid film and partially by surface asperity to surface asperity contact.

Sealed bearing drill bit failures typically occur due to cutter bearing seals wearing until damaged and then the bearings fail before the cutting structure wears out. It is desired to extend the life of sealed bearing drill bits beyond the life of the seals.

SUMMARY OF THE INVENTION

An earth boring bit is disclosed having a dual function pressure compensator for a lubricant reservoir. The earth boring bit is preferably provided by a sealed roller cone rock bit having roller cones which provide cutters. The lubricant pressure compensator is operable in either a sealed lubricant system mode or in an air flow bypass mode selectable prior to securing the earth boring bit to a drill string. The earth boring bit has a bit body and downwardly extending legs which include bearing pins or shafts that extend inward and downward for mounting rotary cutters. Seals are provided between the bearing shafts and the cutters. Lubricant flow passages extend from an interior cavity of the bit body, through the legs and the bearing shafts, and into the spaces located between the bearing shafts and the cutters. The lubricant compensator extends from the flow passage into the cavity with an open end in which a compensator piston is located. The lubricant compensator has an elongate tube with an inward end disposed within the flow passage and a section for receiving the piston when lubricant is expelled from within the elongate tube. Perforations extend through the sidewall of the tube, spaced apart from the end by the cavity, in fluid communication with the flow passages.

The lubricant compensator may be operated in a sealed lubricant system mode by a retainer member selectably locking the piston being in a fixed position within the elongate tube, and the compensator will not provide a pressure compensating function. The lubricant compensator may alternatively be operated in a compensating mode with a flow bypass upon bearing failure by removing the retainer member from securing the piston in place within the elongate tube, prior to securing the earth boring bit to a drill string. With the retainer member removed, the piston is free to move along the length of the elongate tube and provide a pressure compensation function for the lubricant flow passages. After the seals wear between the cutter and the bearing shaft the lubricant will be discharged from within the flow passages, and the piston will move to the lower end of the elongate tube allowing drilling fluids flow through apertures in a lower end of the elongate tube, around the piston and through the lubricant flow passages.

DESCRIPTION OF THE DRAWINGS

For a more complete understanding of the present invention and the advantages thereof, reference is now made to the following description taken in conjunction with the accompanying Drawings in which

FIG. 1 is a perspective view of the sealed earth boring drill bit having a dual function compensator for a lubricant reservoir, with the bit body shown in a one-quarter longitudinal section view;

FIG. 2 is a section view of one leg of the earth boring bit, taken along section line 2-2 of FIG. 1, showing the dual function reservoir with a piston in an initial upper position;

FIG. 3 is a section view of the earth boring bit, taken along section line 2-2 of FIG. 1 showing the dual function reservoir after the piston is moved to a lower position;

FIG. 4 is an exploded view of the dual function compensator for a lubricant reservoir;

FIG. 5 is a sectional view of the bearing shaft of FIGS. 2 and 3, taken along a section plane which is rotated about the longitudinal axis 28 from the views shown in FIGS. 3 and 4; and FIG. 6 is an end view of the bearing shaft, taken along the section plane 6-6 of FIG. 5.

DETAILED DESCRIPTION OF THE INVENTION

Figure 1:
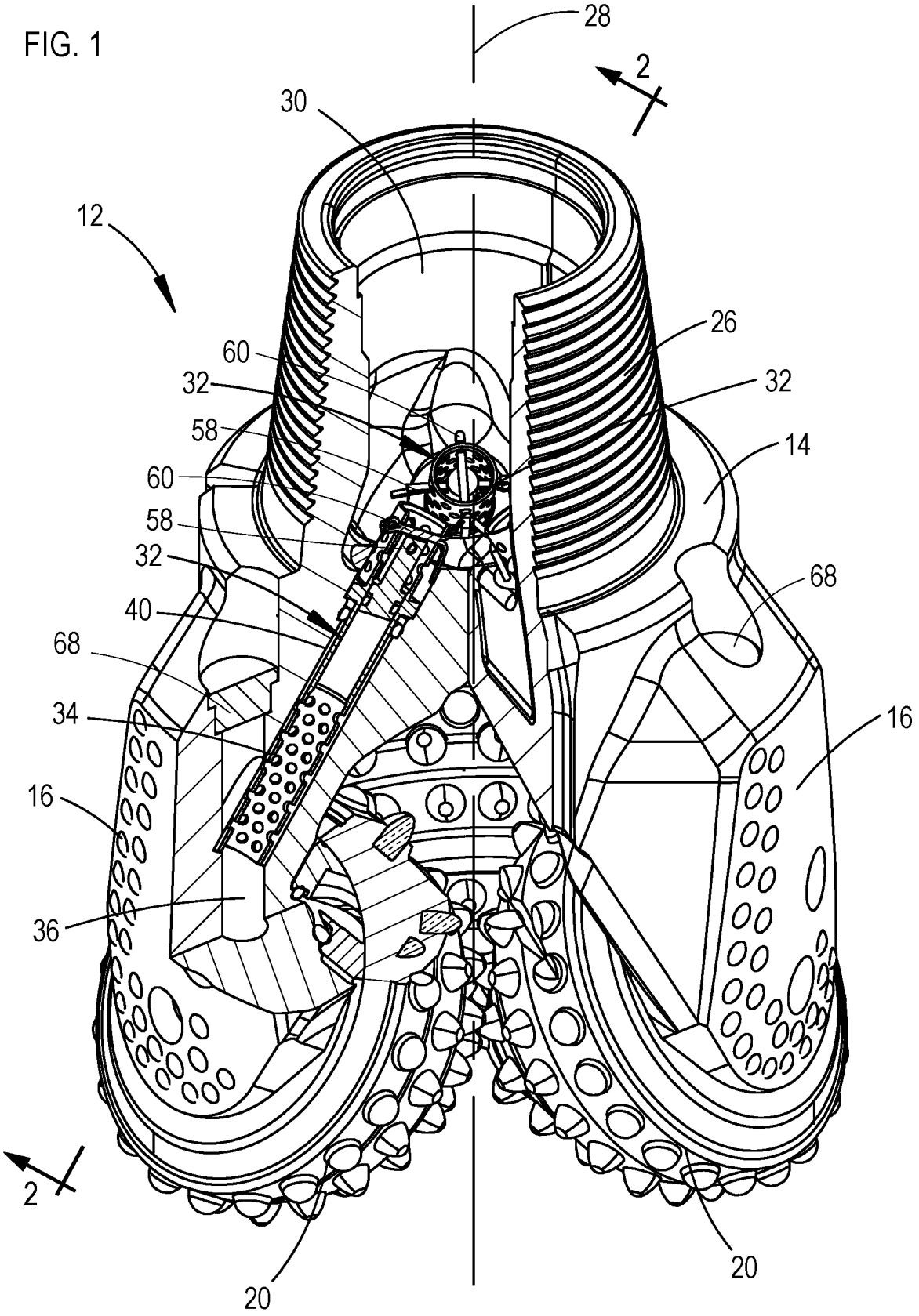
FIGS. 1 through 6 show various aspects for a dual function pressure compensator for a sealed earth boring bit made according to the present disclosure, as set forth below.

FIG. 1 is perspective view of the drill bit 12, with the bit body 14 shown in a one-quarter longitudinal section view. The bit body 14 has at least one depending leg 16, with three legs 16 shown. Rotary cutters 20 are rotatably mounted to the legs 16 by means of bearing shafts 18 (shown in FIG. 3). The cutters 20 are shown having insert type teeth 22, preferably tungsten carbide inserts ("TCI"), but other types of cutting teeth such as steel teeth and abrasive surfaces may be used. The teeth 22 are preferably either tungsten carbide inserts or steel teeth. A nozzle bore 24 is provided in the lower end of the bit body 14 for receiving a flow nozzle and passing drilling fluid from an interior cavity 30 of the bit body 24 onto the cutters 20. The bit body 14 has a bit connection end 26 for connecting to a drill string.

The bit body 14 has central longitudinal axis 28. An interior cavity 30, or bit bowl, extends into the bit body 14 and is connected to the bore of a drill string for receiving drilling fluid which passes through the bit body 14 for cooling the drill bit 12, cleaning cuttings from cutters 20, and circulating upwards through the borehole with the cuttings. Lubricant pressure compensators 32 (two are shown) are mounted in the bit body 14, one for each of the legs 16. The compensators 32 extend from the interior cavity 30 into respective compensator port 34. In each of the legs 16, a lubricant reservoir 33 is defined by combined volume of the compensator port 34, the lubricant passage 36, the lube port 38, the lube port 104, and the portion of the ball port 80 which is not filled with the ball plug 82, which are in fluid communication. An annular space 40 is defined by clearances which extends between the walls of the compensator port 34 and the exterior of the compensators 32. The compensator port 34, lubricant reservoir 36, the lube port 104, the lube port 38, and the ball port 80 are provided by interconnected bores drilled into the body of the leg 16. The lubricant reservoir 36 is provided by a bore hole which extends into the leg 26, preferably parallel to the axis 28. The lubricant reservoir 36 provides a large volume for the lubricant reservoir 33. An outer port of the lubricant reservoir 36 is sealed with a plug 68. A fill port 65 and a bleed port 67 are provided which connect between the lubricant reservoir 36 to the exterior of the leg 26 and the bit 12. The lubricant reservoir 33 may be filled through fill port 65 passage 36 and air bled through the bleed port 67. The fill port 65 and the bleed port 67 may be sealed with a weld after the lubricant reservoir is filled with lubricant. The plug 68 may be used to seal the end of the lubricant reservoir 36.

Figure 3:
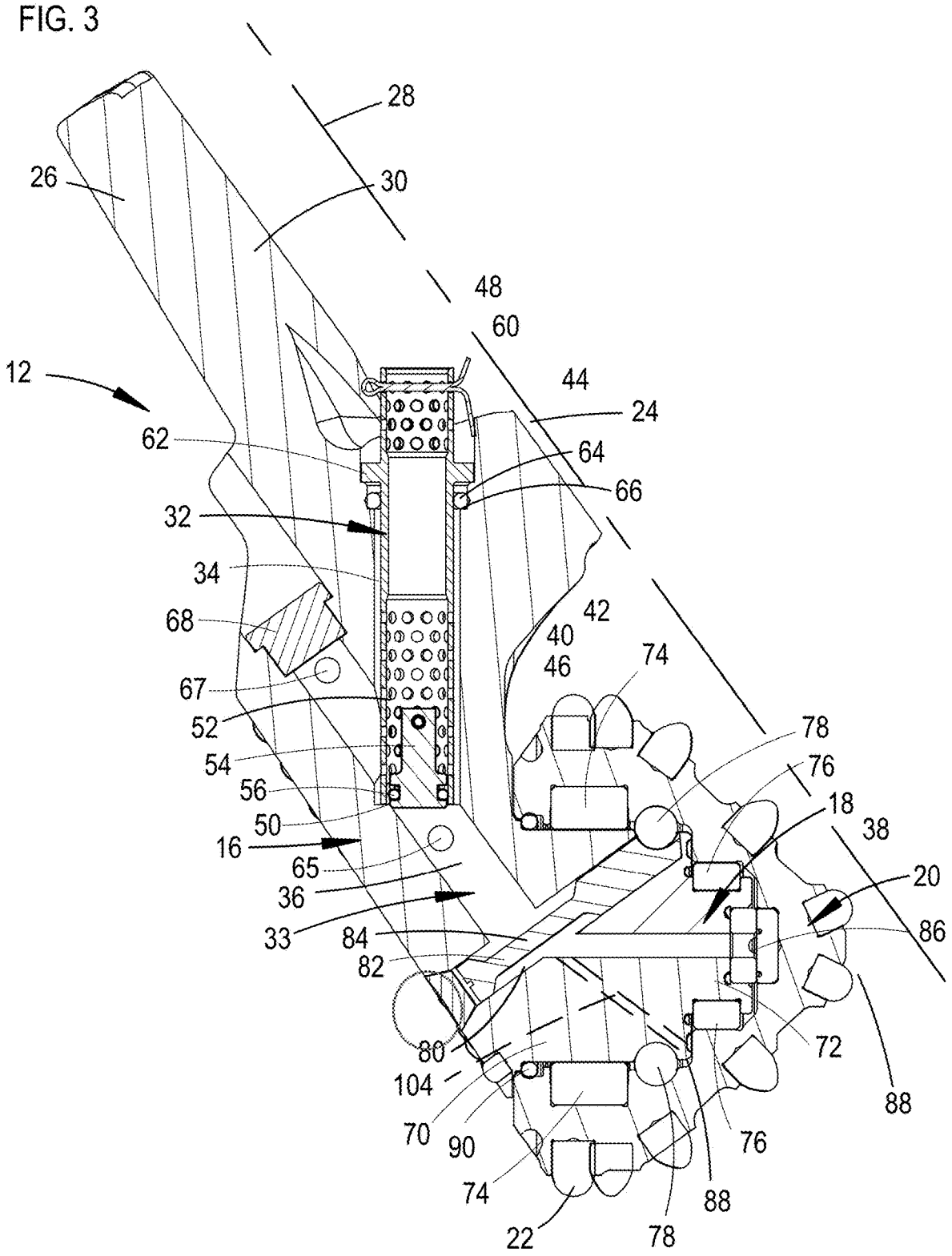
Figure 4:
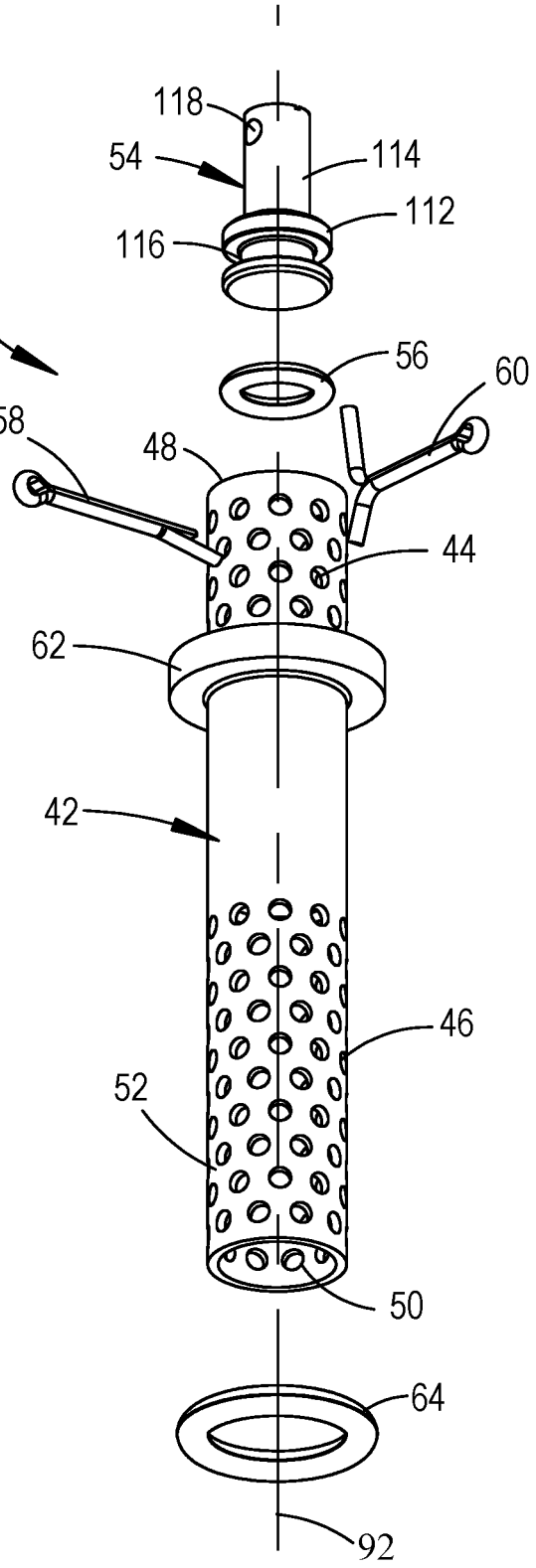

FIGS. 3 and 4 are partial section views of the earth boring bit 12, with FIG. 3 showing the bit 12 configured for operating in a sealed bearing mode and FIG. 4 showing the bit 12 configured for operating in an open bearing mode. The compensator port 34 extends from the interior cavity 30 to the lubricant reservoir 36. The lubricant reservoir 36 is a bore which extends from the bore providing the compensator port 34 to the ball port 80. A lube port 38 is defined by a pilot hole which extends from the ball port 80 to the terminal end of the bearing shaft 18 located at a thrust bearing 86. The compensator port 34 and the compensator 32 are sized to provide the annular space 40 there-between. The annular space 40 provides a flow path for fluid flow from the compensator 32 into the compensator port 34.

The compensator 32 has preferably cylindrical shaped, tubular body defined by a tube 42. The compensator tube 42 has opposite end portions preferably defined by an upper end 48 and a lower end 50. The upper end 48 is disposed in the interior cavity 30 and has apertures preferably defined by perforations 44 which extend circumferentially around the tube 42, adjacent to the upper end 48. The perforations 44 are in fluid communication with the interior cavity 30 and provide fluid communication between the interior cavity 30 and an interior of the tube 42 at the tube end section defined by the upper end 48. The lower end 50 is disposed to extend into the compensator port 34 and has apertures 46 preferably defined by perforations which extend circumferentially around the tube 42, spaced apart from the tube end 50 by a section 52. The section 52 preferably has a tubular shaped interior profile which is sized with a diameter and a longitudinal length for receiving a piston 54, such that the piston 54 is disposed aside of the apertures 46 such that fluid flow from the lower end 42 and the perforations 44 to the apertures 46 is not prevented by the piston 54, as shown in FIG. 3.

The piston 54 is slidably disposed within the tube 42 and has a piston seal 56 preferably provided by an O-ring. A groove 116 circumferentially extends around the piston 54 and, in combination with the interior surface of the tube 42, defines a seal gland for receiving the piston seal 56. A first retainer member 58 is preferably provided by a first cotter pin which extends through a retainer port 118 located in a stem 114 of the upper end of the piston 54 and holes adjacent the upper end 48 of the tube 42 to secure the piston 54 in fixed position within the tube 42, unless the retainer member 58 is removed prior to running the drill bit 12 into a well, as discussed below. A second retainer member 60 is preferably provided by a second cotter pin extending through opposed holes located in the lower end 48 of the tube 42 adjacent to an end of the piston 54 located adjacent to the interior cavity 30. A flange 62 preferably extends circumferentially around an intermediate portion of the tube 42, located between the upper end 48 and the lower end 50. The perforations 44 are preferably disposed between the upper end 48 and the shoulder 62 and provide fluid communication between the compensator port 34 and the interior of the tube 42. The apertures 46 are preferably disposed between the lower end 50 and the shoulder 62 and provide fluid communication between the compensator port 34 and the interior of the tube 42. The flange 62 is preferably welded at the opening of the compensator port 34 to secure the compensator tube 42 to the bit body 14. A recess 66 may be provided to countersink the outward opening of the compensator port 34 for receiving the flange 62. The flange 62 is preferably continuously extending about a periphery of the compensator tube 42, but in some embodiments may be provided by tabs which protrude radially outward from an exteriors surface of the compensator tube 42. When the flange 62 does not continuously extend about a circumference of the compensator tube 42, a seal 64 may be provided by an O-ring for sealing between the exterior of the tube 42 and the compensator port 34. The seal 64 may be omitted when the weld between the flange 62 and the opening of the compensator port 34 provided a fluid tight seal.

The bearing shaft 18 provides a spindle, or a pin, on which the rotary cutter 20 is rotatably mounted. The shaft 18 preferably has a main portion 70 and a pilot portion 72. The outer bearings 74 are provided on the main portion 72, preferably provided by roller bearings. Inner bearings 76 are provided on the pilot portion 72 of the shaft 18, preferably provided by roller bearings. Ball bearings 78 lock the cutters 20 onto the bearing shafts 18 in conventional fashion, with a ball plug 82 welded into the ball port 78 to retain the ball bearings 78 between the bearing races of the shaft 18 and the cutter 20. The ball plug 82 has a tapered portion 84 for fluid to flow from the lubricant reservoir 36 to the lube port 38 in the ball port 80. A thrust bearing 86 is located at the outward end of the bearing shaft 18. An intermediate space 88 is located between the bearing shaft 18 and the cutter 20, provided by clearances between the shaft 18 and the cutter 20. The outer bearings 74, the inner bearings 76, the ball bearings 78 and the thrust bearing 86 are located within the intermediate space 88. A seal 90 extends between the bearing shaft 18 and the cutter 20 to seal the intermediate space 88 located there-between. The seal 90 may be provided by an elastomeric member, such as an O-ring, a metal-to-metal seal, or other type seals such as oval or flat seals preferably formed of an elastomer.

FIG. 4 is an exploded view of the lubricant pressure compensator 32 having longitudinal axis 92. Compensator 32 includes the compensator tube 42, the piston 54 with piston seal 56, the retainer member 58, and the retainer member 60. The piston 54, and piston seal 56 are slidably received within the compensator tube 42. The perforations 44 are shown located at the upper end 48 of the compensator tube 42, and the apertures 46 are shown spaced apart from the lower end 50 by the section 52. The shoulder 62 protrudes between the upper end 48 and the perforations 44, and the lower end 50 and the apertures 46. The piston 54 has a main body portion 112 providing a selectably movable plug for sealing the interior cavity of the compensator tube 42. A seal groove 116 extends circumferentially into the main body portion 112 of the piston 54 for receiving the piston seal 56, which is preferably provided by an annular-shaped, elastomeric seal ring. The piston 54 also has a stem portion 114 which extends upwardly from the main body portion 112 and has a retainer port 118 for receiving and passing there-through the retainer member 58 which preferably will pass through an opposed pair of the perforations 44 through the sidewall of the compensator tube 42, adjacent the end 48. The retainer member 60 will also preferably also preferably pass through two opposed ones of the perforations 44 through the sidewall of the compensator tube 42 to retain the piston 54 within the compensator tube 42, preventing the piston 54 from moving from within the compensator tube 42 and into the interior cavity 30 of the bit body 14. The apertures 46 are shown provided by perforations through the sidewall of the section 52 of the compensator tube 42, adjacent to the lower end 50. The section 52 will receive the piston 54 after lubricant evacuates the compensator tube 42 and the apertures 46 will allow drilling fluid to bypass the piston 42 and flow from within the compensator tube 42 and the compensator port 34, into the lubricant reservoir 36 through the lube port 38. A seal 64 is shown for sealing between the flange 62 and the countersunk recess 66 formed into the bit leg 16.

Figure 2:
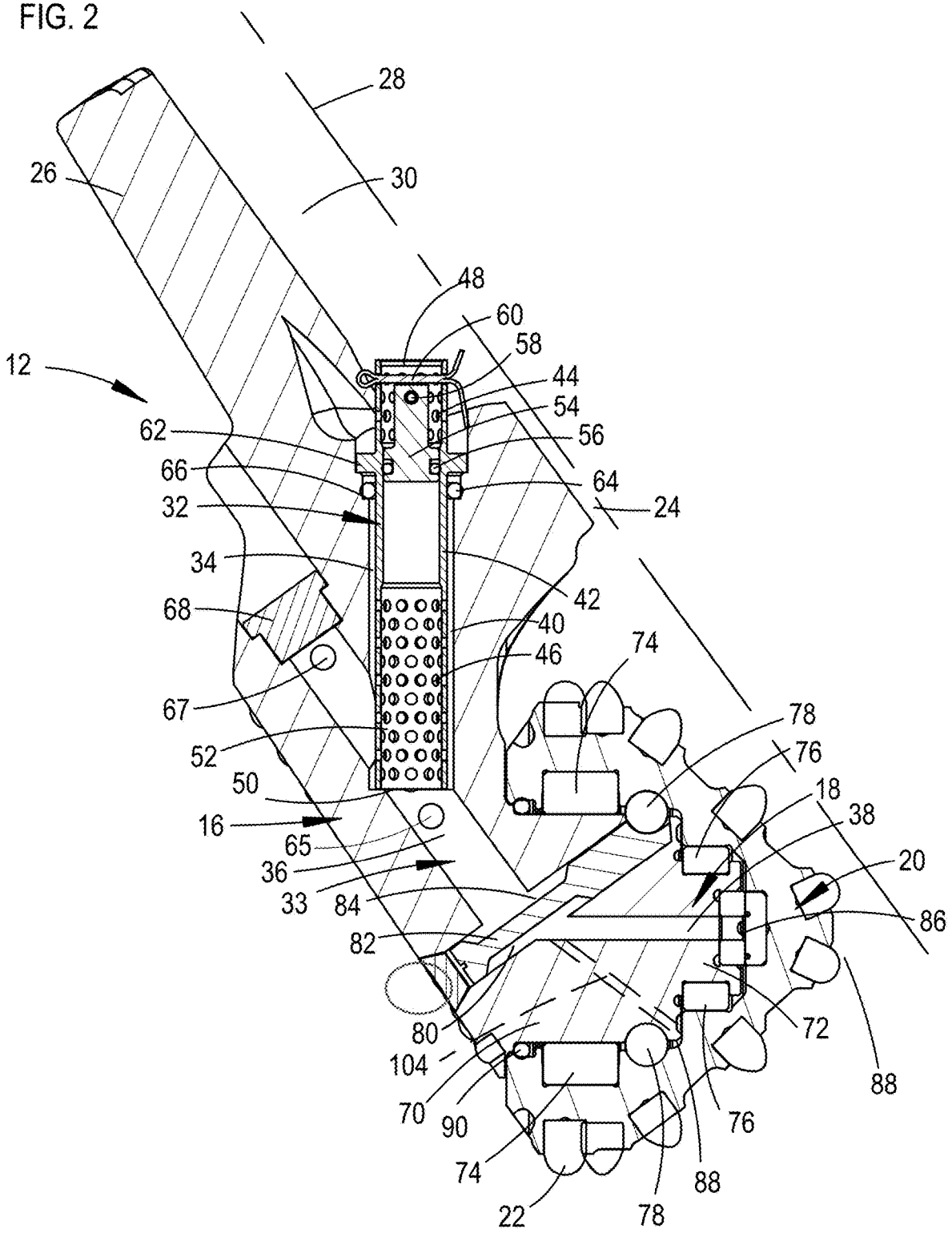
Figure 5:
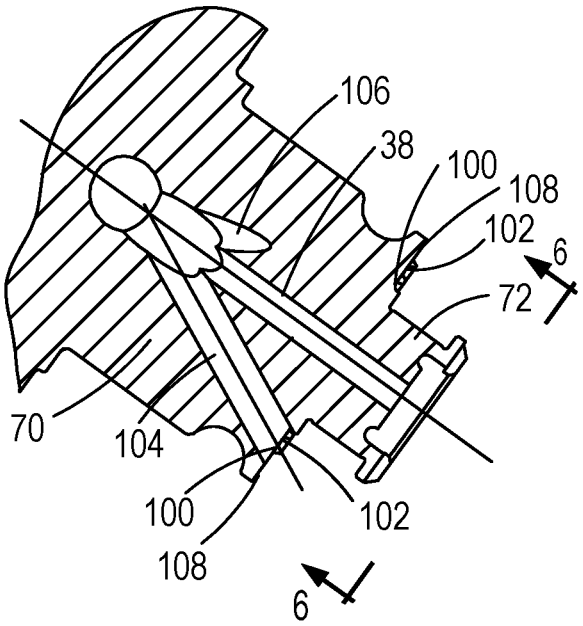

FIG. 5 is a sectional view of the bearing shaft 18 of FIGS. 2 and 3, taken along a section plane which is rotated about the longitudinal axis 28 from the views shown in FIGS. 2 and 3. The lube port 104 extends from the lube port 38 and through the main portion 70 of the bearing shaft flats 108 for passing fluid to the portion of the space 88 adjacent the inner bearings 76. A second lube port 106 extends from the lube port 38 to the second flat 108. A hard facing 102 is disposed in a groove 100 extending into an annular-shaped end face for the main portion 70 of the shaft 18.

Figure 6:
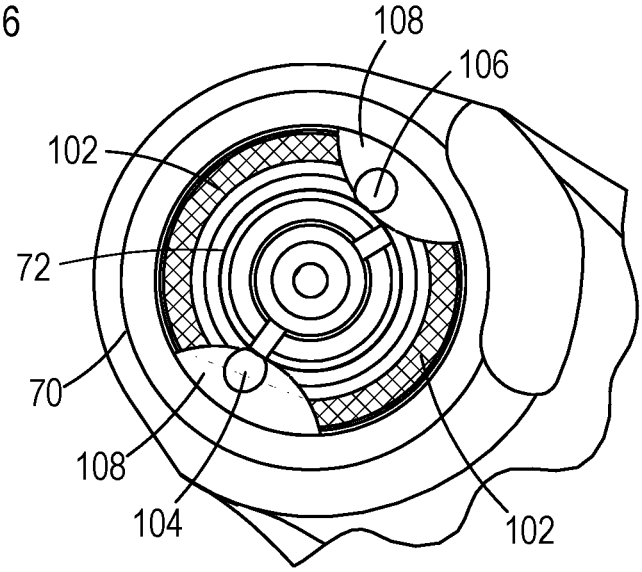

FIG. 6 is an end view of the bearing shaft 18, taken along the section plane 6-6 of FIG. 5. The hard facing 102 is shown disposed on an annular-shaped end surface of the main portion 70 of the bearing shaft 18, adjacent a base portion of the pilot bearing portion 72 of the shaft 18. Two flats 108 are shown disposed on opposite sides of the pilot bearing portion 72. The terminal ends of the lube ports 104 and 106 are shown disposed in the flats 108. The flats 108 are milled in the annular shaped end portion of the outer bearing portion, on opposite sides of the pilot portion 72 of the bearing shaft 18. The flats 108 provide clearance for providing the intermediate space 88 for passing lubricants and later well fluids between a rotary cutter 20 and the bearing shaft 18.

The compensator 32 for the drill bit 12 may be operated in either a sealed lubricant system mode when the piston 54 is locked in place by the lock member 58, or an air flow bypass mode by removing a locking member 58 from securing the piston 54 in place prior to securing the drill bit 12 to a drill string. When operated in the sealed lubricant system mode, or sealed bearing mode, the piston 54 remains in place and the lubricant gravity feeds from the lubricant reservoir 36 and the lube port 38, and the compensator 32 into the bearing spaces between the bearing shaft 18 and the cutter 20. In this mode the compensator 32 does not compensate for the differences in pressure between the lubricant reservoir 36 and the lube port 38, and the pressure in either the lube port 38 and the exterior of the drill bit 12 since the piston 54 is fixed in place within the compensator tube 42.

When the compensator 32 is operated in the air flow bypass mode, locking member 58 is removed from retaining the piston 54 in a fixed position within the compensator tune 43. The piston 54 is free to move in response to differences in pressure between the lube port 38 and the lubricant reservoir 36 and the lube port 38. Initially the compensator 32 will operate in a sealed bearing mode, with the piston 54 disposed in a fixed position within the tube 42 adjacent to the upper locking member 60. Then as the drill bit bearing seals wear and lubricant moves from within the drill bit 12, the piston 54 will be free to move within the compensator tube 42 in response to pressure differences between the lube port 38 and the lubricant reservoir 36. As the well depth and the temperature of the drill bit 12 increases and decreases, the pressure within the lube port 38 will increase and decrease, respectively, changing the pressure applied to the end of the piston 54 disposed adjacent to the interior cavity 30 and the compensator will adjust position within the tube 42. The lubricant fills the compensator port 34, the lubricant reservoir 36, the lube port 38, and the compensator tube 42, which together provide a lubricant reservoir. The piston 54 and the piston seal 56 together provide a moveable seal member which is located in a first position. The piston 54 and the piston seal 56 will together preferably compensate the pressure between to the lubricant reservoir and over that of the borehole pressure adjacent to the bit 12, with the pressure of the drilling fluids of the lube port 38. After drilling the seal 90 wears to failure, at which time the lubricant is evacuated from within the compensator tube 42, being pressed outward of the intermediate space 88 and the seal 90. Pressure in the interior cavity 30 will push the piston 54 from the first position, adjacent the upper end 48, to a second position located in the section 52 and disposed adjacent to the lower end 50, disposed aside of the apertures 46. The bit 12 will then operate in open bearing mode. This allows drilling fluid to flow in a bypass flow path extending from the interior cavity 30, through the compensator 32 and the apertures 46, and into the compensator port 34. The drilling fluid will flow through the lubricant reservoir 36 and the lube port 38, and then will pass through the intermediate space 88 and the region where the seal 90 was disposed to the borehole. The compensator 32 thus has a bypass flow passage for passing drilling fluids through the lubricant reservoir 36 and the lube port 38, and the intermediate spaces 88 to allow the sealed bearing drill bit 12 to be operated in an open bearing mode after failure of the primary cutter bearing seals.

The drilling fluid is preferably air, but other water based or oil based drilling fluids may be used also. It should be noted that the cross-sectional areas of the compensator port 34, the lubricant reservoir 36 and the lube port 38, and the compensator tube 42 are sized for passing an adequate amount of the drilling fluids to provide proper cooling of the bit 12. The cross-sectional area of the lubricant bore is preferably sized to provide the annular space 40 with sufficient size for passing the proper amount of drilling fluids. Similarly, the upper end 48 in combination with the perforations 44 and the apertures 46 are sized for passing this flow of drilling fluids without excessive pressure losses.

The present disclosure provides advantages of an earth boring drill bit which is first operable in a sealed bearing mode. Once the seals fail, the bit is operated in open bearing mode using the drilling fluids for cooling the drill bit. Air is preferably used as the drilling fluid, but water based and oil based drilling fluids may be used as well.

Although the preferred embodiment has been described in detail, it should be understood that various changes, substitutions and alterations can be made therein without departing from the spirit and scope of the invention as defined by the appended claims.

What is claimed is:

1. An earth boring bit comprising:

a bit body;

at least one bearing shaft mounted to the bit body;

a rotary cutter mounted for rotation on the bearing shaft, defining an intermediate space located there-between;

a seal disposed between the bearing shaft and the rotary cutter for sealing the intermediate space from an exterior of the bit;

a flow passage extending through said bit body, from an interior cavity of the bit body to the intermediate space located between the bearing shaft and the rotary cutter;

a dual function compensator extending between said flow passage and the interior cavity of the bit body, said dual function compensator including a compensator body having a first end in fluid communication with the interior cavity and a second end in fluid communication with said flow passage;

said dual function compensator having a moveable seal member disposed in said compensator body for at least initially being disposed in a first position, adjacent to said first end of said compensator body and preventing fluid flow through said compensator body, and moveable to a second position for passing fluid flow through said compensator body;

said dual function compensator further including a retainer member for selectably securing said moveable seal member in said first position, wherein said retainer member is selectable for releasing said moveable seal member from being secured in said first position such that said movable seal member is moveable in response to differences in fluid pressure between said interior cavity of said bit body and said flow passage; and wherein after fluid is expelled from said compensator body, said moveable seal member is disposed in said second position within said compensator body, with said moveable seal member located aside of a flow path for passing fluid flow from said interior cavity of the bit body to said flow passage.

2. The earth boring bit according to claim 1 and further comprising perforations extending through a sidewall of said compensator body for passing drilling fluid from said interior cavity and through said perforations into said compensator body, and apertures extending through said sidewall for passing drilling fluid from said compensator body into said flow passage, wherein said perforations, said apertures, said flow passage, and said intermediate space located between the bearing shaft and the rotary cutter are sized for passing drilling fluid.

3. The earth boring bit according to claim 2, wherein said movable seal member has a main body about which a seal is mounted, and an upwardly extending stem having a retainer port for receiving said retainer member; and wherein said retainer member comprises a removable pin which extends through two opposed ones of said perforations and through said retainer port for securing said movable seal member in said first position.

4. The earth boring bit according to claim 1, further comprising:

said flow passage through said bit body having a terminal end portion disposed adjacent to said interior cavity which defines a compensator port, wherein said compensator port is enlarged over a cross-sectional size of other portions of said flow passage; and wherein said compensator port is sized for receiving said compensator with a clearance disposed between said compensator and said compensator port, and said clearance is sized for passing said fluid flow from said interior cavity of the bit body to said flow passage.

5. The earth boring bit according to claim 4, wherein said compensator has a flange which outwardly extends from an intermediate portion of said compensator, and said flange engages said compensator port defined in said terminal end portion of said flow passage and locates said compensator in said compensator port.

6. The earth boring bit according to claim 5, wherein said flange is welded to said bit body to fixedly secure said first end of said compensator within said compensator port.

7. The earth boring bit according to claim 5, wherein an elastomeric seal is disposed between said compensator and said compensator port for sealingly engaging there-between.

8. An earth boring bit comprising:

a bit body;

at least one bearing shaft mounted to the bit body;

a rotary cutter mounted for rotation on the bearing shaft, defining an intermediate space located there-between;

a seal disposed between the bearing shaft and the rotary cutter for sealing the intermediate space from an exterior of the bit;

a flow passage extending from an interior cavity of the bit body to the intermediate space located between the bearing shaft and the rotary cutter;

a dual function compensator extending between said flow passage and the interior cavity of the bit body, said dual function compensator including an elongate body having a first end in fluid communication with the interior cavity and a second end in fluid communication with said flow passage;

said dual function compensator having a moveable seal member disposed in said elongate body of said compensator for at least initially being disposed in a first position, adjacent to said first end of said elongate body and preventing fluid flow through said elongate body, and moveable to a second position for passing fluid flow through said elongate body;

said dual function compensator further including a retainer member for selectably securing said moveable seal member in said first position, wherein said retainer member is selectable for releasing said moveable seal member from being secured in said first position such that said movable seal member is moveable in response to differences in fluid pressure between said interior cavity of said bit body and said flow passage; and wherein after fluid is expelled from said compensator, said moveable seal member is disposed in said second position within said elongate body of said compensator, with said moveable seal member located aside of a flow path for passing fluid flow from said interior cavity of the bit body to said flow passage.

9. The earth boring bit according to claim 8, wherein said moveable seal member has a main body about which a seal is mounted, and an upwardly extending stem having a retainer port for receiving said retainer member; and wherein said retainer member comprises a removable pin which extends through two opposed ones of perforations said elongate body and through said retainer port for securing said movable seal member in said first position.

10. The earth boring bit according to claim 8, further comprising:

said flow passage through said bit body having a terminal end portion disposed adjacent to said interior cavity which defines a compensator port, wherein said compensator port is enlarged over a cross-sectional size of other portions of said flow passage; and wherein said compensator port is sized for receiving said compensator with a clearance disposed between said compensator and said compensator port, and said clearance is sized for passing said fluid flow from said interior cavity of the bit body to said flow passage.

11. The earth boring bit according to claim 10, wherein said compensator has a flange which outwardly extends from an intermediate portion of said compensator, and said flange engages said compensator port defined in said terminal end portion of said flow passage and locates said compensator in said compensator port.

12. The earth boring bit according to claim 11, wherein said flange is welded to said bit body to fixedly secure said first end of said compensator within said compensator port.

13. The earth boring bit according to claim 10, wherein an elastomeric seal is disposed between said compensator and said compensator port for sealingly engaging there-between.

14. An earth boring bit comprising:

a bit body;

at least one bearing shaft mounted to the bit body;

a rotary cutter mounted for rotation on the bearing shaft, defining an intermediate space located there-between;

a seal disposed between the bearing shaft and the rotary cutter for sealing the intermediate space from an exterior of the bit;

a flow passage extending from an interior cavity of the bit body to the intermediate space located between the bearing shaft and the rotary cutter;

a dual function compensator extending between said flow passage and the interior cavity of the bit body, said dual function compensator including a tubular body having a first end in fluid communication with the interior cavity and a second end in fluid communication with said flow passage;

said dual function compensator having a piston disposed in said tubular body for at least initially being disposed in a first position, adjacent to said first end of said tubular body and preventing fluid flow through said tubular body, and moveable to a second position for passing fluid flow through said tubular body;

said dual function compensator further including a retainer member for selectably securing said piston in said first position, wherein said retainer member is selectable for releasing said piston from being secured in said first position such that said piston is moveable in response to differences in fluid pressure between said interior cavity of said bit body and said flow passage;

wherein after fluid is expelled from said dual function compensator, said piston is disposed in said second position within said tubular body, located aside of a flow path for passing fluid flow from said interior cavity of the bit body to said flow passage;

wherein said tubular body of said dual function compensator has perforations extending through the sidewall of said tubular body for providing fluid communication between an interior of said tubular body and said interior cavity, and said tubular body further has apertures extending between said interior of said tubular body and said flow passage for providing fluid communication there-between; and wherein said apertures, said perforation, said flow passage, and said intermediate space located between the bearing shaft and the rotary cutter are sized for passing drilling fluid.

15. The earth boring bit according to claim 14, wherein said piston has a main body about which a seal is mounted, and an upwardly extending stem having a retainer port for receiving said retainer member; and wherein said retainer member comprises a removable pin which extends through two opposed ones of said perforations and through said retainer port for securing said piston in said first position.

16. The earth boring bit according to claim 14, further comprising:

said flow passage through said bit body having a terminal end portion disposed adjacent to said interior cavity which defines a compensator port, wherein said compensator port is enlarged over a cross-sectional size of other portions of said flow passage; and wherein said compensator port is sized for receiving said compensator with a clearance disposed between said compensator and said compensator port, and said clearance is sized for passing said fluid flow from said interior cavity of the bit body to said flow passage.

17. The earth boring bit according to claim 16, wherein said compensator has a flange which outwardly extends from an intermediate portion of said compensator, and said flange engages said terminal end portion of said flow passage for locating said compensator in said flow chamber.

18. The earth boring bit according to claim 17, wherein said flange is welded to said bit body to fixedly secure said first end of said compensator within said compensator port.

19. The earth boring bit according to claim 16, wherein an elastomeric seal is disposed between said compensator and said compensator port for sealingly engaging there-between.

* * * * *